US005346017A

United States Patent [19]

Blount et al.

[11] Patent Number: 5,346,017

[45] Date of Patent: Sep. 13, 1994

[54] METHOD AND APPARATUS FOR SETTING A WHIPSTOCK

[75] Inventors: Curtis G. Blount, Wasilla, Ak.; Charles M. Hightower, Plano, Tex.; Charles D. Hailey, Oklahoma City, Okla.

[73] Assignee: Atlantic Richfield Company, Los Angeles, Calif.

[21] Appl. No.: 126,420

[22] Filed: Sep. 27, 1993

[51] Int. Cl.[5] ..... E21B 19/00

[52] U.S. Cl. ..... 166/380; 166/117.6

[58] Field of Search ..... 166/117.5, 117.6, 380; 175/58, 61

[56] References Cited

U.S. PATENT DOCUMENTS

| | | | |
|---|---|---|---|
| 3,095,039 | 6/1963 | Kinzbach | 166/117.6 |
| 3,115,935 | 12/1963 | Hooton | 166/117.6 |
| 4,765,404 | 8/1988 | Bailey et al. | 166/117.6 |
| 5,109,924 | 5/1992 | Jürgens et al. | 166/117.6 X |
| 5,195,591 | 3/1993 | Blount et al. | 166/117.5 X |
| 5,222,554 | 6/1993 | Blount et al. | 166/117.6 |
| 5,287,921 | 2/1994 | Blount et al. | 166/117.6 |

*Primary Examiner*—Ramon S. Britts
*Assistant Examiner*—Frank S. Tsay
*Attorney, Agent, or Firm*—Roderick W. MacDonald

[57] ABSTRACT

A method and apparatus for setting a whipstock onto a packer in a wellbore wherein the whipstock is laterally and rotatably movable after it is fixed to the packer, whereby the whipstock can move laterally while rotating so that opposite ends of the whipstock can be made to contact opposing inner walls of the wellbore.

20 Claims, 2 Drawing Sheets

METHOD AND APPARATUS FOR SETTING A WHIPSTOCK

BACKGROUND OF THE INVENTION

In subterranean well operations, it is necessary from time to time to set a whipstock in a subsurface well conduit such as a tubing string or a well casing. The whipstock is set to deviate a mill bit away from the longitudinal axis of the conduit to mill a window in the conduit. Thereafter, a drill bit is passed through the window to drill a deviated wellbore at an angle to the longitudinal axis of the conduit.

The cost and time consumed in using a conventional rotary drilling rig in the foregoing situation is considerable and there has been a trend toward the use of coiled tubing units for these and other well operations heretofore conducted with conventional (jointed straight pipe) drilling rigs.

Coiled tubing units are known in the art, but not widely used in the field yet. Coiled tubing units are nevertheless available on a commercial basis. Inventions such as that disclosed herein will render coiled tubing units more readily useful in the field by reducing both the cost and time expenditures, as compared to a conventional drilling rig, for a given operation.

One beneficial use for a coiled tubing unit is the situation where a wellbore is completed with a first casing that lines the wellbore and then concentric within that first casing a second casing or tubing of a smaller diameter is disposed, but the second casing terminates before the wellbore or first casing terminates. In this type of completion there is a substantial portion of the wellbore and first casing exposed below the end of the smaller diameter, second casing. Coiled tubing is extremely useful in such a situation because the coiled tubing and whatever tools it carries can be inserted into the wellbore through the second, smaller diameter casing; exit from the second casing into the wider diameter first casing; and the tools on the coiled tubing operated within the larger diameter first casing. With coiled tubing units this sort of operation can be carried on without undergoing the considerable time and cost required for removing the smaller diameter second casing before being able to operate in the well below the second casing. This invention allows for a procedure wherein the second, smaller diameter casing is left in place in the well, the whipstock and associated equipment is lowered at the end of coiled tubing through the smaller diameter, second casing until it exits the second casing and then the whipstock is set inside the larger diameter first casing.

SUMMARY OF THE INVENTION

According to this invention there is provided a method and apparatus for setting a whipstock in a subsurface well conduit using a coiled tubing unit.

In accordance with the method of this invention a whipstock is set onto a packer that has previously been placed in a desired position in the wellbore by use of a coiled tubing unit which carries at the end of the coiled tubing a tool combination comprised of a setting tool, whipstock, and connector, the whipstock carrying the connector and the connector being rotatably and slidably connected to the whipstock so the whipstock can move both laterally and rotatably within the wellbore. The connector carries a stinger that is adapted to engage a packer/anchor already in place in the wellbore.

The method of this invention passes the foregoing tool combination into the wellbore by way of the coiled tubing until the stinger engages the packer, thereafter the whipstock is moved laterally and rotatably until the bottom and top of the whipstock come into contact with opposing sides of the well conduit in the wellbore. Thereafter, the setting tool is separated from the whipstock and removed by way of the coiled tubing whereby the whipstock is set in the wellbore even if the wellbore at the place of placement of the whipstock is of substantially greater diameter than the casing through which the whipstock was lowered to the point of placement.

The apparatus of this invention comprises a whipstock carrying at its lower end a connector which is connected to the whipstock in a manner such that when the connector remains fixed in place, such as after engagement with the packer, the whipstock can move laterally and also rotate about a transverse axis to the extent necessary to allow the whipstock to come into contact with opposing sides of the well conduit.

In a particularly useful embodiment of this invention, the whipstock and connector can be fixed to one another by combination of a guide member which is carried in a slot, the slot being angled so that when the guide member moves in the slot the whipstock can move both laterally and rotationally in relation to the connector.

Various aspects, objects and advantages of this invention will be apparent to those skilled in the art from this disclosure and the appended claims.

DETAILED DESCRIPTION

Figure 1:
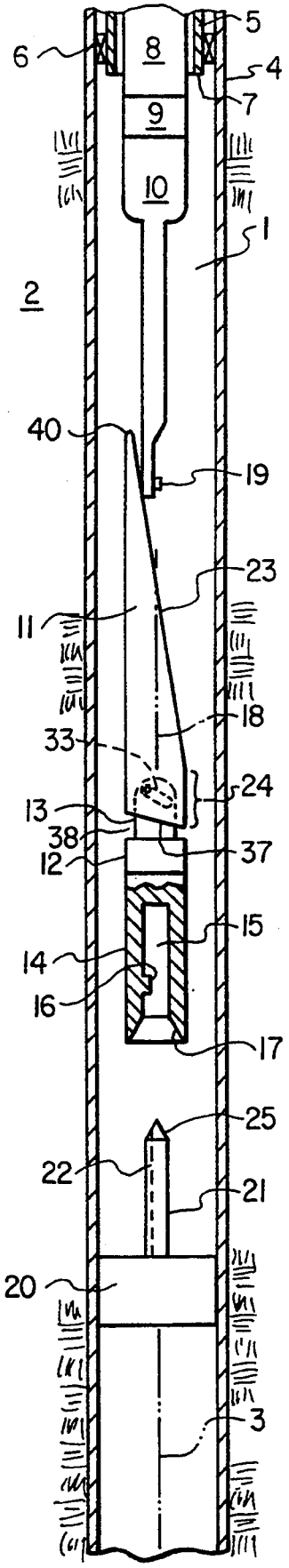
FIG. 1 shows a conventional well completion in the earth which employs a second smaller casing within a first larger casing, FIG. 1 showing one embodiment of the apparatus within this invention where the tool combination is emerging from the second smaller casing just prior to engagement with a packer that was previously set inside the first larger casing.

Referring to FIG. 1 there is shown a wellbore 1 extending down into the earth 2 along an extended longitudinal (long) axis 3. Wellbore 1 is lined with a first, larger diameter casing 4 and carries concentrically in the interior thereof a second, shorter, smaller diameter casing 5, the casings being separated by a conventional packer 6. The lower end 7 of casing 5 ends well before wellbore 1 or casing 4 ends so that upon exiting bottom 7 the well operator has all the interior space provided by larger casing 4 in which to operate his equipment if that equipment can pass through smaller casing 5 and then expand or otherwise move to meet the requirements of the larger interior of casing 4.

By this invention, equipment can be inserted into the wellbore through smaller casing 5, but yet operate within the larger area of larger casing 4 thereby eliminating the necessity to remove any, much less all, of smaller casing 5. This saves considerable time and cost to the well operator.

In this invention coiled tubing 8 carries by way of coupling 9 a setting tool 10. Setting tool 10 carries whipstock 11 by way of a shear member 12. Whipstock 11 has first and second ends, e.g., upper end 40 and lower end 24, and a long axis 18. Shear member 12 is employed so that setting tool 10 can be separated from whipstock 11 after whipstock 11 is placed in the desired location in the well. The lower end of whipstock 11 carries connector 12 which has a shank member 13 that extends into a groove 30 (FIG. 2) in the lower interior of whipstock 11. Shank 13 has an elongate slot 33 in the upper portion thereof. Connector 12 carries at its lower end a stinger 14 which is a hollow body designed to fit over a mandrel. Stinger 14 carries in its hollow interior 15 a guide member 16. The lower end of stinger 14 is flared at 17 to make engagement with a mandrel easier and bypassing of the mandrel more difficult.

Before the apparatus just discussed hereinabove is lowered into the position shown in FIG. 1, a conventional packer/anchor 20 was set in a predetermined location as shown in FIG. 1. Any conventional packer-/anchor that can pass through casing 5 can be employed such as a standard inflatable packer/anchor. Packer 20 carries an upstanding mandrel 21 which carries a guide member groove 22 so that when stinger 14 engages mandrel 21, stinger 14 can be rotated by coiled tubing 8 until guide member 16 engages guide member groove 22. Curved top 25 of mandrel 21 guides key 16 into groove 22. This way the sloped upper end 23 of whipstock 11 will be oriented in the desired direction by the engagement of orienting members 16 and 22 as stinger 14 passes over mandrel 21. Thus, by the time stinger 14 is fully set down on packer 20, whipstock 11 is oriented as desired at which time, by the imposition of extra downward force by way of coiled tubing 8, shear member 12 can be sheared to physically separate setting tool 10 from whipstock 11. Coiled tubing 8, coupling 9 and setting tool 10 can then be withdrawn from the wellbore leaving whipstock 11 resting upon and physically engaged with packer 20, and placed so that the upper sloping end 23 of whipstock 11 and the lower non-sloping end 24 of whipstock 11 come into and are left in contact with opposing interior sides of casing 4 as shown in greater detail in FIG. 7.

Figure 2:
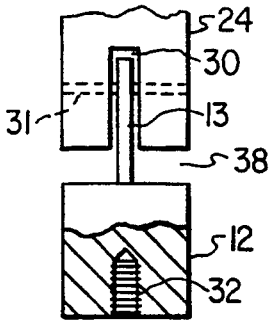
FIG. 2 shows a connector within the scope of this invention as normally mounted in a whipstock.

FIG. 2 shows connector 12 with its shank 13 inserted into the interior of groove 30. Groove 30 extends from the bottom end of whipstock 11 into the interior of non-sloping end 24 of whipstock 11. Shank 13 has a slot 33 therein (FIG. 3) through which passes guide member 31. Thus, guide member 31 is fixed to lower end 24 of whipstock 11 and passes through slot 33 in shank 13 so that there is a slidable and rotatable fit between guide member 31 (and therefore whipstock 11) and shank 13. This way guide member 31 can move in relation to shank 13 when shank 13 and connector 12 are securely fixed in place on mandrel 21 by way of stinger 14. Connector 12 carries at its lower end a threaded recess 32 whereby stinger 14 can be fixed to connector 12.

Figure 3:
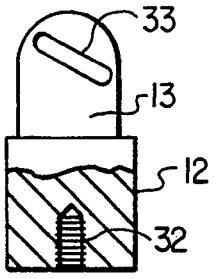
FIG. 3 shows the connector of FIG. 2 separated from the whipstock.

FIG. 3 shows connector 12 of FIG. 2 separated from lower section 24 of whipstock 11, and shows a side view of both shank 11 and slot 33 through which guide member 31 passes as shown in FIG. 2.

Figure 4:
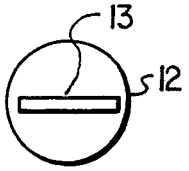
FIG. 4 shows a top view of the connector of FIG. 3.

FIG. 4 shows a top view of connector 12 and further shows that connector 12 is essentially circular in configuration, whereas shank 13 is rectangular in configuration.

Figure 5:
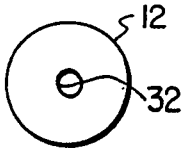
FIG. 5 shows a bottom view of the connector of FIG. 3.

FIG. 5 shows a bottom view of connector 12 with threaded recess 32.

Figure 6:
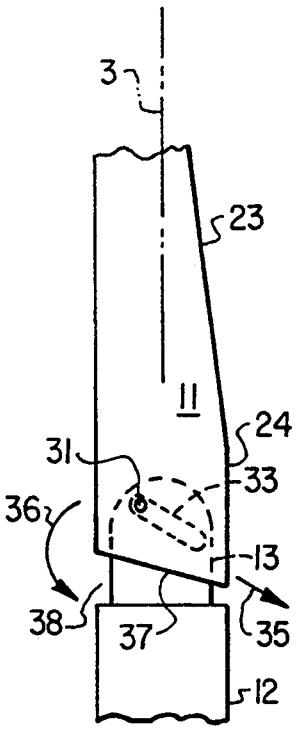
FIG. 6 shows the apparatus moving in the desired lateral and rotational manner in relation to the connector to achieve the final desired positioning of the whipstock as shown in FIG. 7.

FIG. 6 shows whipstock 11 and connector 12 after stinger 14 (not shown) has essentially fully engaged mandrel 21 and whipstock 11 is just beginning the process of moving laterally and rotationally to its final resting position within casing 4. Because guide member 31 is free to move within the constraints of slot 33, and because slot 33 is angled downwardly and to the right, after stinger 14 fully engages mandrel 21 and packer 20, further force applied by way of coiled tubing 8 forces guide member 31 downwardly and to the right as shown by arrow 35 while also imposing a rotating movement on whipstock 11 as shown by arrow 36. To allow for the rotational movement 36 of whipstock 11 the bottom end 37 of section 24 of whipstock 11 is angled upwardly from right to left in FIG. 6 (the angle is shown in exaggerated form in FIG. 6 for sake of clarity) to provide gap 38. This way bottom 37 will not impinge upon connector 12 before the desired rotational movement 36 is fully achieved. Thus, even though connector 12 is firmly fixed to packer 20 and does not move, whipstock 11, by this invention, is free to move both laterally to longitudinal axes 3 and 18 as shown by arrow 35 and rotationally about an axis transverse to long axes 3 and 18 as shown by arrow 36.

Figure 7:
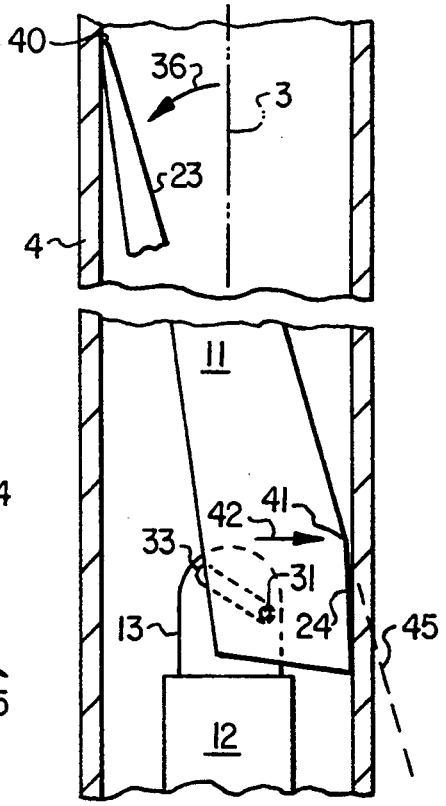
FIG. 7 shows the desired ultimate disposition of the whipstock in the wellbore.

FIG. 7 shows the final desired disposition of whipstock 11 wherein upper end 40 of sloped end 23 of whipstock 11 touches one side of the interior of casing 4 while upper end 41 of non-sloped portion 24 of whipstock 11 closely approaches the opposing side of the interior wall of casing 4. As shown in FIG. 7, at this point guide member 31 has moved downwardly and to the right to the bottom of slot 33. Thus, the horizontal component of movement for arrow 35, as shown by arrow 42 in FIG. 7, has moved upper end point 41 of whipstock 11 horizontally (laterally) into contact with the inner wall of casing 4 while whipstock 11 was rotating, as shown by arrow 36, so that upper end 40 of whipstock 11 could come into contact with an opposing side of the inner wall of casing 4. This is the position desired for whipstock 11 in its final resting place after stinger 14 has fully engaged mandrel 21 and set down on packer 20. This way the non-sloped lower end 24 of whipstock 11 is in full engagement with casing 4 at least at its upper most point 41 so that when a window is subsequently milled in casing 4 in the vicinity of sloped portion 23 of whipstock 11 there will be a smooth transition from whipstock 11 through casing 4 as shown by dotted line 45. This way a bit entering and leaving through the window adjacent sloped side 23 of whipstock 11 will not hang up on casing 4 at point 41 of FIG. 7.

Figure 8:
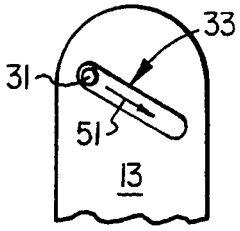
FIGS. 8 through 10 show various embodiments within this invention for the slot feature of the connector.

FIG. 8 shows shank 13 with a straight elongate slot 33 therein. Clearly slot 33 can be longer or at a different angle than that shown in FIG. 8 depending on the particular configuration of the tools and diameter of the wellbore in which this invention is to be practiced.

Figure 9:
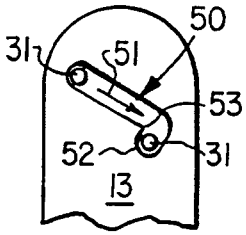

Straight slots are not the only type of slot that can be beneficially employed in the invention. For example, FIG. 9 shows a singly branched or J-slot 50. The angle of slope of either straight slot 33 or J-slot 50 can be used to impart essentially only rotational movement to whipstock 11 or, if desired, can be adjusted so that it provides essentially only lateral movement to whipstock 11 as represented by arrow 42 of FIG. 7, all this occurring as guide member 31 slides downwardly in slot 50 as shown by arrow 51. Of course, the slope of slots 33 or 50 can be such that they impart to whipstock 11 both lateral and rotational movement. For example, the lowest or "J" portion 52 of J-slot 50 can be used simply as a device for catching guide member 31 at its lowest position and essentially holding it in that position by means of inclined surface 53 should an upward movement be imposed upon guide member 31 after it reaches J-portion 52. Alternatively, the sharp drop provided by J-portion or branch 52 can be employed to provide the desired rotating movement (all in or in part) to whipstock 11 as guide member 31 drops down to the bottom of branch 52. Thus, for example, the J-slot can, with or without imposing lateral movement, be employed as a locking and/or rotation imposing device, or both, as desired by those skilled in the art.

Figure 10:
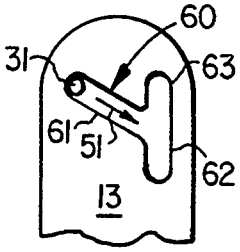

Yet another embodiment of a slot within the scope of this invention is shown in FIG. 10. FIG. 10 shows a T-slot 60 wherein the straight downwardly sloping portion 61 terminates not in one branch, as shown in FIG. 9, but in two branches, i.e., a sharply dropping branch 62 and upwardly extending branch 63.

Figure 11:
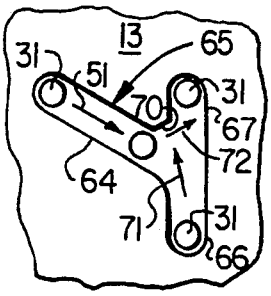
FIG. 11 shows a T-slot within this invention in greater detail as to its operation in relation to the guide member.

FIG. 11 shows one species of a T-slot within this invention wherein as guide member 31 moves downwardly in straight portion 64 of T-slot 65, as represented by arrow 51, it can provide the same lateral and/or rotational function as discussed hereinabove with respect to slots 33 and 50, but when guide member 31 reaches lower branch 66 it drops sharply down for any of the movement imparting reasons discussed hereinabove with respect to J-portion 52 of FIG. 9. The difference with T-slots 60 and 65 is that should upward movement of guide member 31 occur after it has dropped into lower branch 62 or 66, guide 31 is more likely not to move upwardly and to the left to its original position in T-slot 60 or 65, because of the presence of upstanding branches 63 and 67 which allow guide member 31 to move into upstanding branch 63 or 67 instead.

Surface 70 is employed in slot 65 so that should guide member 31 tend to move toward the upper left, as represented by arrow 71, it will impact sloped surface 70 which will then physically deflect guide member 31 back to the right, as shown by arrow 72. This way guide member 31 will be forcibly directed into upstanding branch 67 and locked in place there until the upward exertion on guide member 31 is removed and guide 31 falls back to the bottom of branch 66.

Accordingly, from the foregoing it can be readily seen that many different slots of many different configurations and slopes or combination of slopes can be employed within the scope of this invention. The angle of slope of the slots, as well as the variety of branch ends of the slots, can be employed in many ways to provide the desired lateral and/or rotational guidance movement to whipstock 11, as well as locking functions, when guide member 31 moves in various directions in a given slot. It is also clear that an essentially straight slot, as shown for slot 33, or any amount of single or complex branching or complex sloping of a slot can be employed within the scope of this invention to achieve the beneficial advantages of this invention. Accordingly, literally an infinite variety of configurations of guide slots can be employed within this invention, guide slots 33, 50, and 60 representing only a very few possibilities.

Figure 12:
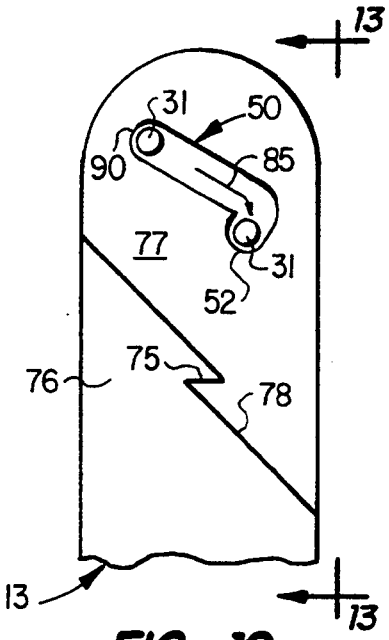
FIG. 12 shows yet another embodiment within this invention wherein the slot feature is combined with a separate lock feature and a separate cam feature.

FIG. 12 shows yet another embodiment within this invention wherein J-slot 50 is employed, as disclosed in detail hereinabove with respect to FIG. 9, and in addition shank 13 carries a lock member 75 which is composed of an essentially horizontal shoulder cut back into a raised portion 76 that is integral with the main body 77 of shank 13. Below lock member 75 is a cam surface 78 which is designed to guide a cam member in a manner which will be described in greater detail hereinafter. It can be seen then that shank 13 can be made to incorporate either a physical lock member or a cam surface or both, and as can be seen from FIG. 14 more than one lock member and/or more than one cam surface can be employed on the same shank.

Figure 13:
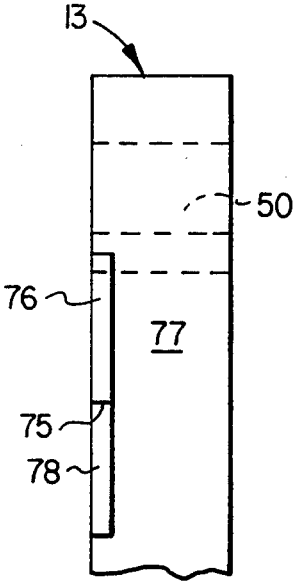
FIG. 13 shows a side view of the member of FIG. 12.
Figure 14:
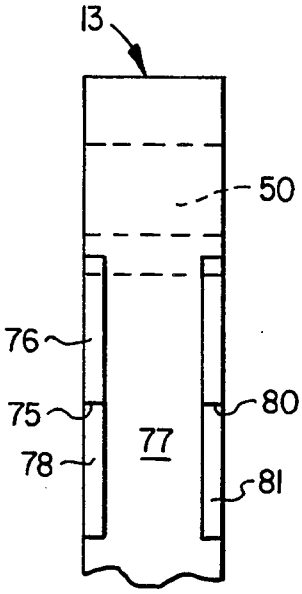
FIG. 14 shows another embodiment for the member of FIG. 12.

FIG. 13 shows a front view of shank 13 of FIG. 12, while FIG. 14 shows the shank of FIG. 12 with an additional lock member 80 and cam surface 81 on the opposite side of shank 13 from lock member 75 and cam surface 78.

Figure 15:
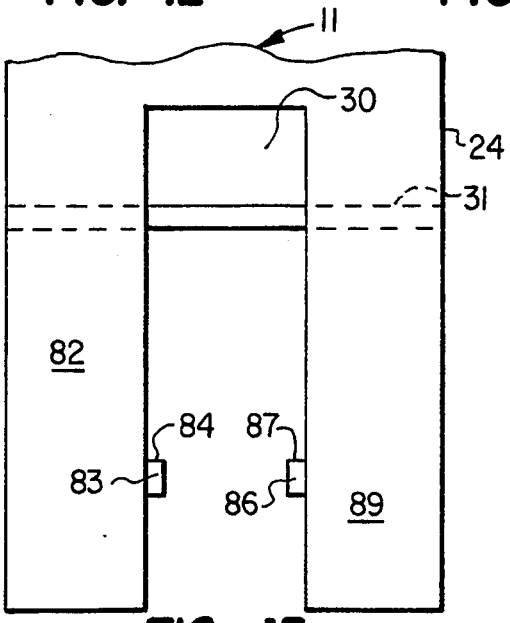
FIG. 15 shows a portion of a connector within this invention which is useful with the member of FIG. 12.

FIG. 15 shows non-sloped lower portion 24 of whipstock 11 from a front view and displays the full dimensions of groove 30 in whipstock 11. It also shows that guide member 31 extends through both sides or legs 82 and 89 of whipstock 11 that extend on either side of groove 30. Guide 31 need not extend fully through both sides 82 and 89 of whipstock 11 for this invention, but should extend entirely through groove 30. Shank 13 of connector 12 is, for more clarity, absent from the interior of groove 30 in FIG. 15. FIG. 15 shows leg 82 of portion 24 of whipstock 11 to carry extending into the interior of groove 30 a cam/lock member 83. Top 84 of cam 83 serves as the locking surface when cam/lock member 83 is in a locked position, as shown in greater detail in FIG. 16. Only whipstock cam member 83 would be present in the interior of groove 30 when used with the shank shown in FIG. 13 which has only a single lock 75. Locks 75 and 83 are situated in relation to one another so that when guide member 31 is in the upper left portion 90 of slot 50 of FIG. 12, lock members 75 and 83 are in contact with one another. This way, when the tool combinations of this invention are run into the wellbore as shown in FIG. 1, the weight of the apparatus, i.e., connector 12 and stinger 14, is split between abutting lock members 75 and 83 on the one hand and guide member 31 on the other hand. Cam/-lock member 83 is located in relation to cam surface 78 and below lock member 75 so that cam member 83 follows cam surface 78 as members 75 and 83 disengage from their locking position since, by this time, stinger 14 is fully set down upon packer 20. Cam member 83 following cam surface 78 provides a guidance movement to whipstock 11 which movement is in addition to any guidance movement provided to the whipstock by way of guide member 31 moving downwardly as shown by arrow 85 in FIG. 12.

Of course, it is well within the skill of the art and the scope of this invention to reverse the cam member and cam surface thereby providing a cam member on shank 13 and the corresponding cam surface on the inner side of leg 82 of whipstock 11. Whipstock 11, as shown in FIG. 15, would employ only cam member 83 when used with the shank shown in FIG. 13, but when used with the shank shown in FIG. 14, a second cam member 86 with upper lock surface 87 would be employed.

Figure 16:
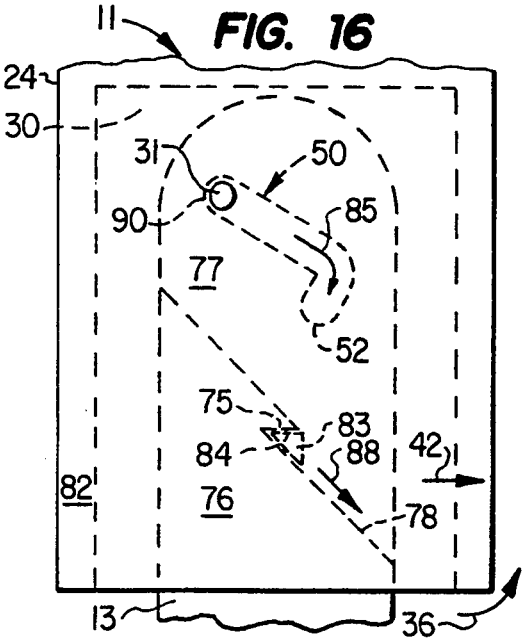
FIG. 16 shows the apparatus of FIGS. 12 and 15 when joined together and operating in the manner of this invention.

FIG. 16 shows shank 13 of FIG. 12 disposed inside groove 30 of FIG. 15 with guide member 31 disposed as shown in FIG. 15 and extending through J-slot 50 at the upper portion 90 thereof. FIG. 16 also shows first cam/-lock member 84 of whipstock 11 in physical contact or otherwise engaged with opposing second lock member 75 of shank 13. When members 75 and 84 are so engaged in a locked position with guide member 31 in the upper portion 90 of slot 50, the equipment of this invention is in the position shown in FIG. 1. When shank 14 fully engages mandrel 21 and is set down upon packer 20, guide member 31 has slid downwardly in slot 50 to the bottom of branch 52 of slot 50, as shown by arrow 85, and at the same time cam member 31 has slid downwardly along cam surface 78 as shown by arrow 88 to cause whipstock 11 to undergo its desired lateral translation as represented by arrow 42 and its desired rotational movement as represented by arrow 36 to put whipstock 11 in the final desired position shown in FIG. 7 even though during all such movement connector 12 does not move because of its rigid connection to fixed packer 20 by reason of engagement of shank 14 with mandrel 21.

The angle of slope of slot 50 and cam surface 78 can be essentially the same or can be different. When the angles of slope of the shank slot 50 and the cam surface 78 are different, they can be used for the same or different movement imparting functions. For example, the slope of slot 50 could be adjusted so that it primarily provides rotating movement 36 to whipstock 11 while the angle of slope of cam surface 78, which is different from the angle of slope of slot 50 in this situation, is such that it primarily provides lateral movement 42 to whipstock 11. Of course, the slope angles of slot 50 and cam surface 78 could be changed relative to one another to provide just the reverse of the foregoing, i.e., slot 50 providing primarily lateral movement 42 while cam surface 78 provides primarily rotating movement 36. A combination of the two movements can also be accomplished by adjusting the relative slopes of slots 50 and 78 so that lateral translation and rotational translation are provided by both the slot and the cam surface at the same or different times during the movement of guide member 31 down to the bottom 52 of slot 50. For example, initially cam surface 78 could provide the rotational movement 36 while slot 50 provides essentially only lateral movement 42 until guide member 31 drops into the essentially vertical J-branch 52 of slot 50. At the time guide member drops into the bottom of the branch 52 of slot 50 substantial rotating movement 36 could then be provided by slot 50 even though it had provided no rotational movement up until the time guide member dropped into the bottom of branch 52. Other obvious combinations and permutations are possible within the scope of this invention to achieve the desired results of this invention as set out hereinabove.

Once whipstock 11 is set in the desired position shown in FIG. 7, the well is in a position to have a window milled through the side of casing 4 which faces slope 23 of whipstock 11 so that a deviated well can then be drilled from inside casing 4 to the outside of casing 4 and then extended at an angle to long axis 3 of original vertical wellbore 1.

The apparatus shown in FIG. 1 can be employed, for example, on a well which is completed in a manner such that casing 4 is 7-inch outside diameter (approximately 6.1-inch inside diameter) pipe, and casing 5 is 4.5-inch outside diameter (about 4-inch inside diameter) pipe using a whipstock 11 that is approximately 20 feet long. This well configuration requires a lateral movement 42 for point 41 of whipstock 11 of approximately 1.25 inches, a similar lateral distance being necessary for the upper end 40 of whipstock 11 as it rotates to reach the wall of casing 4 as shown by arrow 36 in FIG. 7.

Reasonable variations and modifications are possible within the scope of this disclosure without departing from the spirit and scope of this invention.

What is claimed is:

1. In a method for setting a whipstock which has first and second ends onto a packer which is fixed in a wellbore in the earth, said wellbore having a long axis that extends into the earth, the improvement comprising the stage of: providing a coiled tubing injection unit carrying coiled tubing for insertion into a well conduit that extends along said long axis; providing at one end of said coiled tubing a tool combination comprising a setting tool which carries said whipstock, said whipstock being connected to said setting tool by a shear member, said whipstock carrying a connector that is rotatably and slidably connected to said whipstock so that said whipstock can move laterally to said long axis and rotate about an axis that is transverse to said long axis, said connector carrying a stinger that is adapted to engage said packer; passing said tool combination into said wellbore by said coiled tubing until said stinger engages said packer; moving said whipstock laterally to said long axis and rotating said whipstock about an axis transverse to said long axis until said first and second ends of said whipstock come into contact with opposing sides of said well conduit; and shearing said shear member to separate said setting tool from said whipstock.

2. The method according to claim 1 wherein said packer carries a mandrel, said mandrel having a guide member, and further comprising the step of orienting said whipstock with said guide member as said stinger and mandrel engage one another.

3. Apparatus for setting a whipstock onto a packer in a wellbore comprising a whipstock which has a first sloping end and an opposing second end, said second end carrying a connector, said whipstock having a long axis that extends from said first end to said second end, said connector being rotatably and slidably connected to said whipstock so that said connector can move laterally to said long axis and rotate about an axis that is transverse to said long axis.

4. The apparatus according to claim 3 wherein said whipstock and connector are connected by way of a slot and pin so that said whipstock can move laterally and rotate at essentially the same time.

5. The apparatus according to claim 3 wherein said connector is fixed to a stinger for engaging a packer.

6. The apparatus according to claim 5 wherein said stinger is fixed to a guide member for orienting said whipstock while said stinger engages said packer.

7. The apparatus according to claim 6 wherein said stinger has a hollow body for receiving a mandrel, said stinger carrying in its hollow body a guide member for engaging said mandrel to orient said whipstock.

8. The apparatus according to claim 3 wherein said whipstock has a groove in its second end, said connector has an upstanding shank which fits into said groove, said shank has a guide slot therein, a guide member fixed to said connector and passing through said guide slot in said shank to fix said connector to said whipstock, whereby said connector is carried by said whipstock by way of said guide member and said whipstock moves by way of said guide slot both laterally and rotationally in relation to said connector.

9. The apparatus according to claim 8 wherein said guide slot is essentially a straight slot.

10. The apparatus according to claim 8 wherein said guide slot is a branched slot.

11. The apparatus according to claim 8 wherein said guide slot is one of a J-slot or T-slot.

12. The apparatus according to claim 8 wherein said guide slot is angled downwardly in relation to said long axis to cause said guide member when moving in said guide slot to move said whipstock laterally to said long axis.

13. The apparatus according to claim 12 wherein said whipstock rotates as said guide member moves in said guide slot.

14. The apparatus according to claim 13 wherein said guide slot has a single branch so that the branch drops sharply at the bottom of the guide slot slope thereby providing a rotating movement to said whipstock as said guide member drops into said branch.

15. The apparatus according the claim 8 wherein said whipstock is fixed to (i) at least one first lock member and (ii) at least one first cam member, and said shank is fixed to (i) at least one opposing second lock member adapted to engage said first lock member and (ii) at least one second cam member adapted to engage said first cam member.

16. The apparatus according to claim 15 wherein said whipstock lock member and said shank lock member engage one another when said whipstock is being placed in the wellbore thereby splitting the weight load of the apparatus between said lock member and said guide member.

17. The apparatus according to claim 15 wherein said whipstock carries in its groove said at least one first lock member and said at least one cam member, and said shank carries said at least one opposing second lock member and said at least one second cam member.

18. The apparatus according to claim 15 wherein the angle of slope of said shank guide slot and the angle of slope of said first and second cam members are essentially the same.

19. The apparatus according to claim 15 wherein the angle of slope of said shank guide slot and the angle of slope of said first and second cam members are essentially different from one another.

20. The apparatus according to claim 19 wherein the angle of slope of said shank guide slot rotates said whipstock and the angle of slope of said first and second cam members moves said whipstock laterally.

* * * * *